BEST AVAILABLE COPY

United States Patent [19]

Yamada et al.

[11] Patent Number: 4,661,371

[45] Date of Patent: Apr. 28, 1987

[54] METHOD OF PRODUCING AN EXHAUST VALVE FOR DIESEL ENGINE

[75] Inventors: Takemi Yamada, Tokyo; Tamataro Satoh, Yokohama; Masaaki Mizushina, Fujisawa; Koji Toyota; Hiromi Okamoto, both of Yokohama, all of Japan

[73] Assignee: Nippon Kokan Kabushiki Kaisha, Tokyo, Japan

[21] Appl. No.: 839,088

[22] Filed: Mar. 13, 1986

Related U.S. Application Data

[60] Continuation-in-part of Ser. No. 705,087, Feb. 25, 1985, abandoned, which is a division of Ser. No. 315,666, Oct. 28, 1981, Pat. No. 4,530,322.

[30] Foreign Application Priority Data

Oct. 31, 1980 [JP] Japan ..... 55-152264
Sep. 24, 1981 [JP] Japan ..... 56-149620

[51] Int. Cl.[4] ..... C23C 4/08
[52] U.S. Cl. ..... 427/49; 427/423; 427/190
[58] Field of Search ..... 427/49, 190

[56] References Cited

U.S. PATENT DOCUMENTS

| | | | |
|---|---|---|---|
| 1,559,439 | 10/1925 | Kapraun | 123/668 |
| 3,975,165 | 8/1976 | Elberg | 427/191 |
| 4,248,940 | 2/1981 | Goward | 427/423 |

FOREIGN PATENT DOCUMENTS

| | | | |
|---|---|---|---|
| 767594 | 9/1967 | Canada | 427/423 |
| 2856232 | 7/1980 | Fed. Rep. of Germany AA | 123/188 |

*Primary Examiner*—Sam Silverberg
*Attorney, Agent, or Firm*—Moonray Kojima

[57] ABSTRACT

A method of producing an exhaust valve for a diesel engine comprising the steps of cutting a part of a valve or valve seat body, depositing or spraying onto the cut part a mixture of grains of ceramics and metals, and varying the proportion of grains of ceramics and metals during the deposition or spraying so that the deposited or sprayed layer will vary in content of metal and ceramics with the proportion of ceramics increasing with the increase in height from the valve or seat body of the coated layer, and then subjecting the coating to pressure of 3 to 7 Kg/mm$^2$ and concurrently heating the coating to 700° to 800° C., thereby to produce a contact surface which forms the contact point between the valve and valve seat which has better adhesion, is close to the body, and has better corrosion resistance, anti-invasion properties, and good thermal shock resistance.

5 Claims, 8 Drawing Figures

BEST AVAILABLE COPY

BEST AVAILABLE COPY

BEST AVAILABLE COPY

BEST AVAILABLE COPY

METHOD OF PRODUCING AN EXHAUST VALVE FOR DIESEL ENGINE

This is a continuation-in-part of Ser. No. 705,087 filed 2/25/85, now abandoned, which was a division of Ser. No. 315,666 filed 10/28/81, now U.S. Pat. No. 4,530,322 issued 7/23/85.

BACKGROUND OF THE INVENTION

1. Field of Invention.

This invention relates to a method of producing an exhaust valve for a Diesel engine, and more particularly, to such a method wherein the contact surfaces between the valve and seat are formed by a coated layer of a mixture of ceramic grains and metal grains, with the proportion of ceramic grains in the mixture being greater toward the surface than toward the valve and seat bodies.

2. Discussion of Prior Art.

Diesel engine exhaust valves now used are easily burned by exhaust gases, especially in the middle speed and high speed Diesel engines which exhaust gases of high temperatures, and more especially when inferior or lower grade fuel is used. Burning occurs of the surfaces which form the contact point between the valve and the seat. The exhaust gases contain oxides of low melting point, such as $V_2O_5$ or $Na_2SO_4$, which penetrate into the contact surfaces and cause oxidation which is accelerated by high temperatures. This is referred to as the blowing and burning phenomena.

A conventional means of dealing with the problem is to use a Cr-heat resistant steel or Ni-based super heat resistant alloy for the valve body and seat body, with a portion of the body at the contact surfaces being prepared with weld padding or coat padding of corrosion resistant alloy of base of Co or Ni having a high hardness factor (e.g. Hv 600 to 700). However, when fuel is inferior, the contact surfaces are usually instantly damaged by the blowing and burning phenomena, since it is only padded with the corrosion resistant alloy.

Another approach has been to make the contact surfaces of a coated layer of Co or Ni based alloy having ceramic grains uniformly dispersed therein. But, this was found to be poor in durability to repeated shocks. Also, such a coated layer of alloys having ceramic grains uniformly disposed therein is of low density and the layer is of low melting point, which accelerates oxidation at high temperatures, so that the blowing and burning phenomena still exists.

Thus, in the art, there still exists a deficiency in that no method exists for the preparation of exhaust valves for a diesel engine wherein the contact surfaces between the valve and valve seat have such desired properties as thermal shock resistivity, toughness, resistance to cracks, resistance to exfoliation, and corrosion resistance, and elimination of the blowing-burning phenomena.

SUMMARY OF THE INVENTION

Accordingly, an object of the invention is to overcome the aforementioned and other deficiencies and disadvantages of the prior art.

Another object is to provide a method which produces contact surfaces in valves and valve seats which are excellent in corrosion resistance, in thermal shock resistance, in toughness, in exfoliation and in preventing blowing-burning phenomena, and which also have such properties as good adhesion between the coated layer forming the contact surface and the valve body or seat body, and forms close contact therebetween.

The foregoing and other objects are attained in the invention which encompasses a method wherein the valve body or seat body is coated with a layer of a mixture of ceramic grains and metal grains, with the proportion of ceramic grains being increased from zero at the valve or seat body to 100% at the layer surface which forms the contact surface. Thus, toward the body surface adhering to the layer, the layer forms mostly of metal grains. With this changing composition within the coated layer, the above problems have been substantially solved.

DETAILED DESCRIPTION OF PREFERRED EMBODIMENTS

Figure 1:
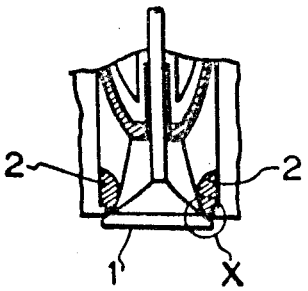
FIG. 1 is a vertical cross sectional view depicting an illustrative exhaust valve produced according to the invention.
Figure 2:
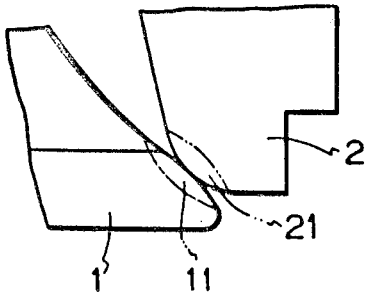
FIG. 2 is a partially enlarged view of the area designated X in FIG. 1.

Turning to FIGS. 1 and 2, an exhaust valve body 1 and a valve seat body 2 are depicted, with valve having a contact surface $1_1$ and the seat having a contact surface $2_1$, which contact each other during operation of the valve. The inventive method acts to produce a coated layer for these contact surfaces.

Figure 3A:
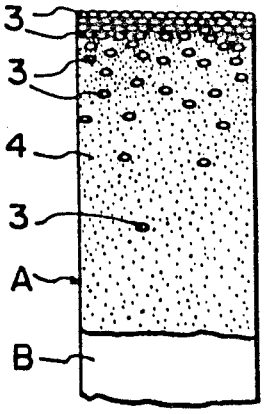
FIGS. 3A, 3B, are cross sectional views depicting exhaust valves produced according to the method of the invention.
Figure 3B:
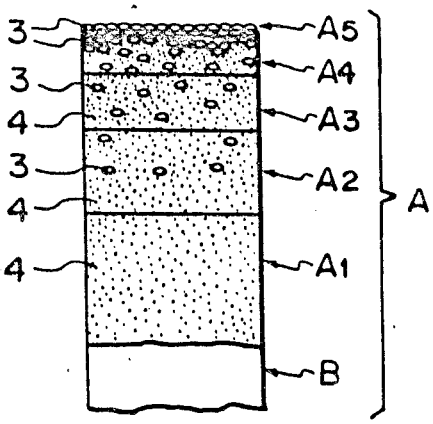

FIGS. 3A, and 3B depict two different types of coating layers, with FIG. 3A depicting a single layer A of a mixture of metal grains 4 and ceramic grains 3 deposited or sprayed on valve or seat body B, and with FIG. 3B depicting a plurality of layers $A_1$, $A_2$, $A_3$, $A_4$ and $A_5$ of a mixture of metal grains 4 and ceramic grains 3 deposited or sprayed on valve or seat body B. As depicted, the proportion of ceramic grains to metal grains increases from nearly 0% at the body surface B toward the contact surface at the top of the figure to nearly 100% thereat. In FIG. 3A, the process is continuous until the coated layer is completed. In FIG. 3B, after one layer $A_1$ is completed of a selected dimension, another layer $A_2$ is completed, etc. until the plurality of layers is deposited. Each of the layers $A_1 \ldots A_5$, has the composition of the mixtures of ceramic grains and metal grains changed as the subsequent layers are deposited with the proportion of ceramic grains increasing from the first layer to the last.

Figure 4:
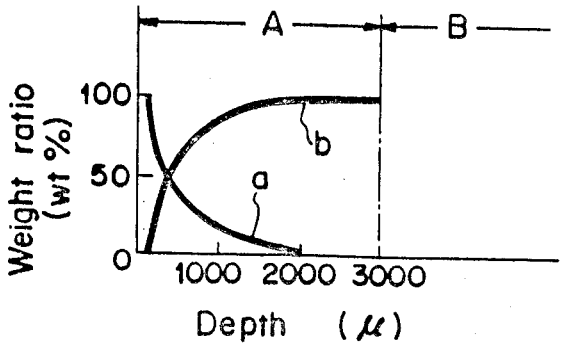
FIG. 4 is a graph depicting the mixture in terms of weight ratio of grains of ceramic to grains of metal, in the direction from the valve or seat body to the contact surface.

FIG. 4 shows the proportion of ceramic grains a to metal grains b in terms of weight percent, going from contact surface (0 microns) to valve or seat body surface (3,000 microns) with the proportion of ceramics to metal going from 100% to 0%. This is for Example 1.

BEST AVAILABLE COPY

The ceramics to be used in the coating are various kinds of oxides, nitrides, etc. Representative examples are $Al_2O_3$, $TiO_2$, $ZrO_2$, BN, SiN. The metal grains used in the invention may be alloys, such as for example, NiCrAl, NiCrCo, and NiCrMo. The sizes of the grains should be no more than 0.3 microns for optimal effect.

The grains of metal alone, ceramic alone, or metal and ceramic combined, are prepared by first sintering, then pulverizing, and the pelletizing, to the desired sizes. The pelletized grains are then mixed in suitable proportions, such as shown in FIG. 4, and then deposited or thermal sprayed to the desired coated layer thickness. When spraying, the smallest sized particles are not sublimed. Sizes up to 30 microns may be used for an undercoating, if desired.

It is preferable to use several different kinds of metals having different properties, such as corrosion resistance and strength, so that such properties may be added to the coated layer. For example, a layer having an excellent corrosion resistant property may comprise NiCrAl toward the contact surface, and toward the bottom of the layer may comprise, for example, a metal excellent in strength, such as NiCrMo, and furthermore, in the middle of the coated layer, the metal contact may be such as to impart excellent corrosion properties, and strength, such as NiCrCo.

The metal and ceramic grains are of sizes up to 0.3 microns and can be readily applied to a mixer prior to placement in the plasma gun or thermal sprayer, or mixed in the plasma gun or thermal sprayer, in any desired proportion and using any desired type or types of metal and ceramic grains.

It is to be understood that metal covered ceramic grains can also be used. Moreover, the invention is not limited to one or five layers, as shown in FIGS. 3A, 3B, but may comprise any number of layers as desired. Also, the contact surface of the layer or layers need not be 100% ceramic, and in some cases may comprise a small amount of metal grains. Similarly, the portion next to the body surface on which the layer is coated may comprise less than 100% metal grains. For example, the lower portion may comprise a small amount of ceramic grains. Some ceramics do not have a high degree of strength or toughness. In that case, a bit more grains of metal in the proportion may be added. By adjusting the amounts of metal and ceramics in the bottom portion and in the contact surface portion, and in the intermediate portion, the optimum properties for the coated layer is obtained, such as high corrosion resistance, toughness, exfoliation resistance, anti-invasion, and prevention of blowing burning phenomena.

The valve body and valve seat body comprise a heat resistant hard steel or alloy, such as 12% Cr steel; 15% Cr steel-14% Ni steel; 1N7136, or NIMONIC alloy. The body material must have resistance to hot corrosion and have high temperature strength, such as creepage strength.

The thickness of each layer in a multi-layered coating is preferably between 30 to 500 microns. This provides good corrosion resistance and good thermal shock resistance. In order to prevent penetration of molten oxides, at least 70 microns thickness is desired. Above the upper limit of 500 microns produces cracks when the surface is heated and soaked at 800° C. and water cooled. However, when the lower layer portion is of metal grains of 100 microns, it is more preferable that the thickness of the layers of mostly ceramic grains be 100 microns.

It has been found that the thickness of the lower metal portion depends on the coarseness of the valve or seat body 1,2. At least 100 microns thickness is prefered to absorb thermal shock or shock occuring upon contact of the valve and seat. The upper limit of the lower metal layer portion is less than 1000 microns from an economic view.

The overall thickness of the coated layer, regardless of the number of layers, is preferably between 130 to 6,000 microns, and more preferably between 350 to 2000 microns. If a double layer structure is formed, with the upper layer being mostly ceramics and the lower layer being mostly metal, a more preferred thickness is between 250 to 400 microns.

Prior to the coating layer being deposited or sprayed on, the valve or valve seat body, such as body 1,2 (in FIG. 2) is first prepared by cutting a piece out of the body 1,2 in the area where the valve contacts the valve seat. Instead of cutting a piece out of the body, such body can be formed with such indentation. The piece cut out should be of sufficient depth to enable the coated layer to be of suitable depth. Subsequently, the area is blasted with white alumina powder. Then, the blast powder is removed and the area is degreased. Thereafter, the coating is undertaken by deposition by a plasma gun, or spraying by thermal sprayer.

The type of plasma gun or thermal sprayer used in the invention is well known. Two such types are the "Plasma Gun" and "Thermalspray" which are sold by Metco, Inc, of Westbury, N.Y. and similar types sold by Plasma Days Corporation. These devices shoot out streams of particles, such as the grains of ceramics and metals, and deposit the grains onto a prepared surface, such as the valve or valve seat body. The metal grains and ceramic grains are added to the gun or sprayer continuously in varying propositions, ranging from 0% to 100% ceramics and 100% to 0% metals, as the sprayer or gun is operating and the mixed ceramic - metal mixture is being sprayed on or deposited. For example, the amounts found in FIG. 4 in the proportions shown, can be used.

The proportion of ceramic grains to metal grains being deposited at any time during the coating process may be varied as desired Since very little loss occurs during deposition or spraying, the proportion of ceramics desired in the coated layer at the particular depth, can be readily determined and deposited by fixing that proportion in the mixture applied to the plasma gun or thermal sprayer. The sizes and weights of the metal and ceramic grains and rates of deposition and spraying are readily measurable, and the desired height of the coated layer is readily available, the specific mixing ratio of ceramic grains to metal grains is readily determined and applied to the gun or sprayer to produce the desired make up of the layer at different depths. The weight ratios shown in FIG. 4 for the mixture of ceramic grains to metal grains produced the coated layer having the proportions at the different depths of the layer desired.

It is to be understood that the sintering process and the pulverizing process and pelletizing process are of any type known in the art. These are well known process in the field of metal working and are not per se part of the invention.

After the coating of FIG. 3A is completed, a press heat treatment is applied to the coated layer, to complete the adhering of the layer to the body and to further harden same. This press heat treatment can be applied to each of the layers $A_1 \ldots A_5$ of FIG. 3B or

BEST AVAILABLE COPY each layer can be separately applied and then after layer $A_5$ is applied, the entire multiple layer can be subjected to press heat treatment.

Figure 6:
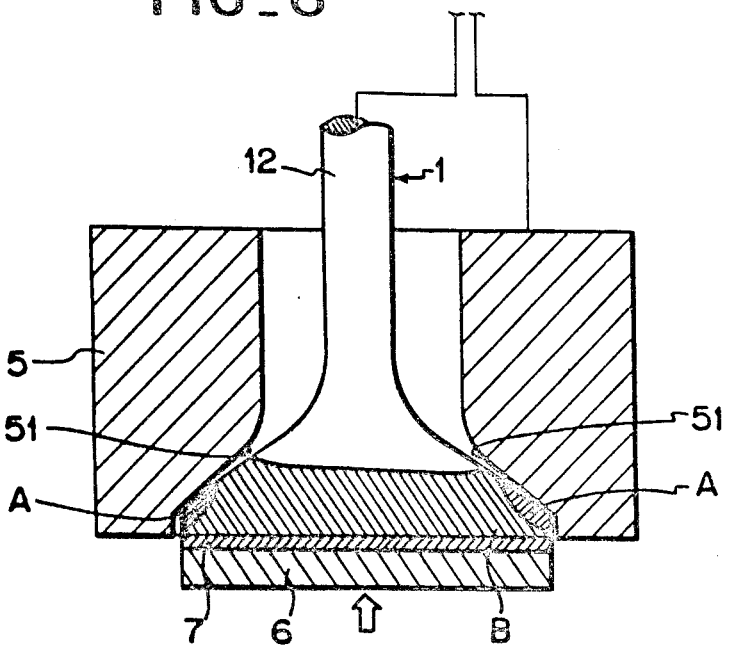
FIG. 6 is an explanatory view depicting an apparatus used to press heat treat a coated layer on a valve.
Figure 7:
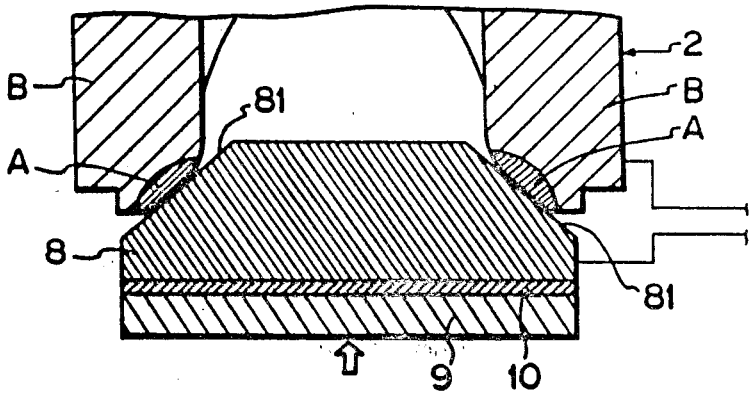
FIG. 7 is an explanatory view depicting an apparatus used to press heat treat a coated layer on a valve seat.

FIGS. 6,7 depict apparatus which may be used to press heat treat the coated layer, with FIG. 6 directed to press heat treatment of a valve, and FIG. 7 directed to press heat treatment of a valve seat. In each of these apparatus, there is applied a force shown by an arrow, to cause the coated layer to be pressed against a block with a predetermined amount of force, while concurrently applying a predetermined temperature, in a non-oxidizing atmosphere. In FIGS. 6,7, a predetermined electric current is applied so that the electric current will act upon the resistance of the coated layer and cause the layer to heat up to the desired temperature. Other temperature raising means may be used.

Turning to FIG. 6, valve body 1 is inserted into tool 5 at its corresponding part, and coated layer A forming the contact surface contacts an inner circumference $5_1$ of the tapered part. A tool 6 applied to the lower part of body 7 via insulator 6 pushes the valve body so that layer A is pressed against surface $5_1$ of tool 5 with a predetermined amount of force shown by the arrow. Concurrently, electric current is applied via the unmarked wires located toward the top of FIG. 6, to valve bar 12 and tool 5, to cause the heating of layer A to a predetermined temperature.

Turning to FIG. 7, coated layer A which forms the coating contact surface of valve seat 2, contacts an outer surface $8_1$ of tapered part of tool 8. A tool 9 applies to the lower tool 8 via insulator layer 10, a force (see arrow) which pushes the tool 8 so that layer A is pressed against the outer surface $8_1$ of tool 8 with a suitable force. Concurrently, electric current is applied via unmarked wires on the right side of the FIG. 7, to valve seat 2 and tool 8, to cause heating of the layer A.

The press heating tool 5,8 are made of a hard material, such as NIMONIC 8A alloy (which comprises C=0.1%, Si=1.0%, Cu=0.2%, Fe=3.0%, Mn=1.0%, Cr=20.0%, Ti=2.3%, Al=1.4%, Co=2.0%, remainder being Ni.) and has a coating of solid lubricant, such as graphite lubricant, at the surfaces $5_1$,$8_1$, whereat contact is made with coated layer A.

The temperatures, pressures and electric current used in the press heat treatment, are preferably as follows. Coated layer A is heated preferably by electric current acting on the resistance of the coated layer, to cause such layer to become heated, to a temperature of up to 900° C. with a more preferable ranging being 700° to 800° C. Electric current of 200 volts and 1,500 amps will produce in the coating layer sufficient heat to cause the temperature to be within that range. The force on the pressing apparatus must be sufficient to enable the ignoring of creep deformation of the valve body or valve seat body. The preferred pressure is a maximum of 10 $Kg/mm^2$, and more preferably between 3 to 7 $Kg/mm^2$. The non-oxidizing atmosphere is preferably Argon, although other non-oxidizing gases may be used.

A number of tests were carried out, and are set forth below as examples.

EXAMPLE 1

Ceramic grains, which were priorly sintered, pulverized and pelletized, of less than 0.3 microns, comprising $Al_2O_3$ (60%)+$TiO_2$ (30%)+$ZrO_2$ (10%); and metal grains, which were priorly sintered, pulverized and pelletized, of less than 0.3 microns, comprising NiCrAl alloy (COLMONOY 6), were used in varying proportion, in a plasma gun, in one case, and in a thermal sprayer in another case, as the deposition and spraying proceeded. The valve and seat bodies were made of NIMONIC 80A alloy. The proportions of ceramic to metal grains used are shown in FIG. 4. A one layer coated layer, such as shown in FIG. 3A, was formed, by deposition in one case, and by spraying, in another case. The total coating thickness was 3,000 microns.

From 0 to 30 microns from the contact surface, the layer was 100% ceramic grains. From 2,000 to 3000 microns from the contact surface, the layer was 100% metal grains. The portion between these two parts, namely, between 30 microns to 2,000 microns from the contact surface, was a mixture of ceramic and metal grains, in the proportion shown in FIG. 4. Since there was very little loss the weight percent of the mixture applied to the gun or spray is what is deposited or sprayed, and appears in the coated layer.

The coating then was subjected to press heat treatment wherein a pressure between 3 to 7 $Kg/mm^2$, and an electric voltage of 200 v at 1,500 amps was applied to the FIGS. 6,7 apparatus to produce a temperature at the coating of between 700° to 800° C.

Tests were carried out and it was found that the coating had good corrosion resistance, strength, anti-invasion properties, and was not subject to the blow and burn phenomena, had good thermal shock resistance, and had very good adhesion to the valve body and valve seat body.

EXAMPLE 2

A 5 layer coating (such as shown in FIG. 3A) was prepared using the techniques of EXAMPLE 1, except the following compositions were used. The valve and seat body material was of NIMONIC 80A alloy. Layer 1, which was 0 to 30 microns fromt the contact surface, was substantially all ceramic grains, namely, $Al_2O_3$ (60%)+$TiO_2$(40%). Layer 2, which was 30 to 150 microns from the contact surface, was as follows: 65% ceramic grains comprising $Al_2O_3$(60%)+$TiO_2$ (30%)+NiCr(10%), and 35% metal grains comprising NiCrAl. Layer 3, which was 150 to 500 microns from the contact surface was as follows: 65% ceramic grains comprising $Al_2O_3$(90%)+NiCr(10%), and 35% metal grains comprising NiCrAl. Layer 4, which was 500 to 2,000 microns from the contact surface, was as follows: 15% ceramic grains comprising $Al_2O_3$ (90%)+NiCr(10%) and 85% metal grains comprising NiCrAl. Layer 5, which was 2,000 to 3,000 microns from the contact surface, was 100% metal grains, namely, NiCrAl(CROLMONOY 6). The weight ratios of the mixture of ceramics to metal grains were substantially as that obtained in the layer.

The multiple coating layers were subjected to press heat treatment after layer 1 (i.e. contact surface layer) was deposited, in one case by plasma gun, and was sprayed on, in another case, by thermal sprayer. Argon gas was used. A current of 200 volts and 1,500 amps was used to obtain a temperature of 700° to 800° C., while concurrently a pressure of between 3 to 7 $Kg/mm^2$ was applied.

Examples 1 and 2 were tested for such properties as exfoliation, corrosion resistance and thermal shock resistance, and were all found to be excellent. Also, the produced coated layer or layers were found to have excellent hardness at high temperatures. The coated layer adhered excellently to the valve and seat bodies at

BEST AVAILABLE COPY the interface of the coating and body. The adhering was found to be close. It was also found that close adhesion was doubly useful in that invasion of harmful substances and burnt material into the valve or seat body was prevented from occuring.

EXAMPLE 3

The conditions used were as in the above Example 1 and the following samples 1,2,3,4 were obtained, and a sample was produced, as sample 5, as a comparison sample wherein the layer was of ceramic grains as shown below. Then tests were carried out for exfoliation, anti-invasion, and thermal shock. The samples were produced by having the mixture ratio of ceramic grains to metal grains altered to produce the layers shown below. Also, in the 3rd sample, metal covered ceramic grains were used, with the metal covering layer being 0 to 75% of the total weight of the grains. Sample 4 was press heat treated, as in Example 1, using the sample 3 coated layer.

Composition of layers in the samples 1,2,3,4,5. The proportions of the ceramic grain and metal grain were varied during the deposition or spraying in the same ratios as deposited in the layers. Very little loss took place during the deposition and spraying.

Sample 1. Lower portion next to valve body of 100 to 200 microns thickness, contained metal grains of 80% Ni, 20% Cr; and upper portion next to contact surface of 150 to 500 microns, contained ceramic grains of $Al_2O_3+TiO_2$.

Sample 2. Lower portion next to valve body of 100 to 200 microns thickness, contained metal grains of 80% Ni, 20% Cr; and upper portion next to contact surface of 150 to 500 microns, contained a mixture of metal grains and ceramic grains comprising 80% ceramic grains of $Al_2O_3$, and 20% metal grains of 50% Cr and 50% Ni.

Sample 3. Lower portion next to valve body of 100 to 300 microns, contained metal grains of 80% Ni, 20% Cr; and upper portion next to contact surface of 200 to 800 microns, contained metal of 50% Ni, 50% Cr covering ceramic grains of $Al_2O_3+TiO_2$, in which the metal varied from 75% to 0% and ceramics varied from 25% to 100% with the 100% ceramics at the contact surface.

Sample 4. Sample 3 was press heat treated.

Sample 5. A single coated layer of 100 to 200 microns comprising all ceramic grains of $Al_2O_3+TiO_2$. A base layer of 50 microns of 80% Ni and 20% Cr was deposited first on the valve body.

Tests were carried out to determine effects of exfoliation, anti-invasion and thermal shock. Comparative sample 5 caused exfoliation on the surface in 150 hours of actual work, and the overall ceramic layer was exfoliated in 1400 hours. On the other hand, the inventive samples 1,2,3,4 were exfoliated as follows. Sample 1, 2500 to 3500 hours. Sample 2, 3500 to 5000 hours. Sample 3, 5000 to 7000 hours. Sample 4, 7000 to 10,000 hours.

To determine effects on anti-invasion properties, Vicker's hardness tests were conducted by measuring the load value at which cracks were produced in the coating surface. In Comparative Sample 5, cracks were produced at pressures of 300 to 500 grams. On the other hand, the inventive samples 1,2,3,4 produced the following results. Sample 1, cracked at pressures of 300 to 500 grams. Sample 2, cracked at pressures of 1,000 grams. Sample 3, cracked at pressures of between 1,000 to 5,000 grams. Sample 4, cracked at pressures of 10,000 to 30,000 grams.

Figure 5:
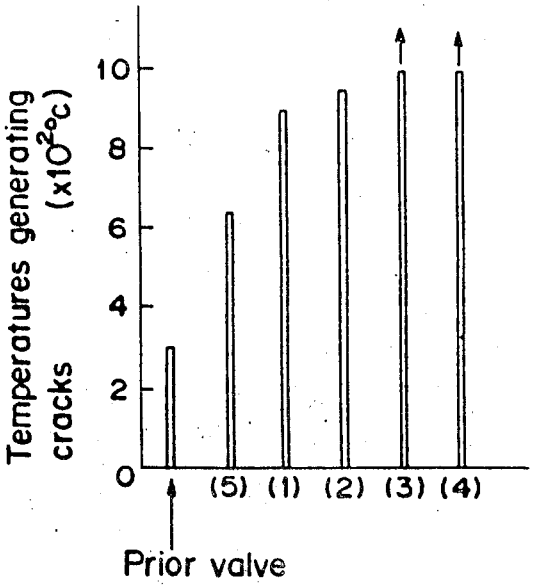
FIG. 5 is a graph depicting effect of thermal shock on samples of the invention and a comparison sample.

Next thermal shock resistivity was tested and the results were plotted on graph of FIG. 5, wherein the temperature at which cracks were generated, is charted for each of samples 1–4 and comparative sample 5, and the prior art. Thermal shock resistivity was measured by taking a sample and immersing same into water after heating and determining the temperature at which the sample cracked. Comparative sample 5 is one wherein weld padding was on the valve surface. In FIG. 5, although some degree of satisfactory results were obtained with sample 5, the prior art sample, was clearly not satisfactory, and inventive samples 1–4 were substantially better than the prior two. The prior art sample and comparative sample 5 could not fully absorb thermal shock due to the difference in thermal expansion coefficients of the ceramic layer and the valve body so that cracks were created at heating temperatures of 650° C.

In summary, the inventive method produced a coated layer which was excellent in hardness at high temperatures and had excellent corrosion resistance. The amount of corrosion at high temperature was found to be reduced by ½ to 1/10 of conventional valves having weld padding on the contact surface. Our mixture of ceramic grains and metal grains of varying amounts prevents penetration of oxides of low melting points, such as $V_2O_5$, $Na_2SO_4$, etc into the interior of the layer and prevents occurrence of accelerated oxidation at high temperatures. Thus, blow-burning phenomena due to accelerated oxidation is prevented from occurring. Since the presence of ceramic grains in the coating brings about reaction with low melting point oxides at temperatures as high as 900° C., high temperature corrosion due to low melting point oxides rarely takes place in the temperature range of 600° to 700° C. which is the usual operating range of exhaust valves.

In addition, since metals are contained in the lower part of the coating, the surface is tough and excellent in adhesion to the valve seat or valve body. It is especially remarkable when the ceramic metal mixture makes up the intermediate portion of the coated layer. High hardness is imparted to the contact surface by the presence of the ceramic so that invasion of hard substances is also prevented. Also, the ceramic top surface prevents adhesion of harmful substances such as burnt remains, and furthermore, the temperature around the valve or seat body near the coated layer is lowered when the valve is subject to water cooling. Thus, the depositing or spraying of the coated layer enables the coated layer to be closer than with the prior art, and to have better adhesion of the coated layer to the body.

The foregoing description is illustrative of the principles of the invention. Numerous modifications and extensions thereof would be apparent to the worker skilled in the art. All such modifications and extensions are to be considered to be within the spirit and scope of the invention.

What is claimed is:

1. A method of forming an exhaust valve for a diesel engine, comprising the steps of preparing a valve body or valve seat body by removing a predetermined dimension of said valve body or valve seat body at points where said valve body comes into contact with said valve seat body;

BEST AVAILABLE COPY forming grains of ceramic and grains of metal, by sintering, then pulverizing, and then pelletizing ceramic material and metal material;

depositing or spraying said grains of ceramic and said grains of metal on said valve body and said valve seat body where a portion was removed;

concurrently changing the proportion of grains of ceramic to grains of metal being deposited or sprayed, with the proportion of grains of ceramic to grains of metal increasing from a range of 0% to 100% from time depositing or spraying begins until depositing or spraying is completed to form a completed coated layer;

concurrently subjecting said coated layer to pressure of up to 10 $Kg/mm^2$ and temperatures of up to 900° C., thereby to form a hardened contact surface where said valve body and said valve seat body touch each other, with the contact surfaces being of a substantial majority of ceramic grains and the portion of said coated layer being next to the valve body or valve seat body being of a substantial majority of metal grains, with the portion therebetween varying in increasing amounts of ceramic grains from said portion next to said valve or valve seat body to said portion next to said contact surface.

2. The method of claim 1, wherein said temperature is caused by application of electric current of 200 volts at 1,500 amps, at the coated layer.

3. The method of claim 1, wherein said coated layer is between 300 to 6,000 microns.

4. The method of claim 1, wherein said ceramic grains are selected from the group consisting of $TiO_2$, $Al_2O_3$, $ZrO_2$, BN, SiN; and wherein said metal grains are selected from the group consisting of NiCrAl, NiCrCo and NiCrMo.

5. The method of claim 1, wherein said pressure is between 3 and 7 $Kg/mm^2$, and said temperature is between 700° and 800° C.

* * * * *